US009527555B2

(12) United States Patent
Ketterman et al.

(10) Patent No.: US 9,527,555 B2
(45) Date of Patent: Dec. 27, 2016

(54) ADJUSTABLE KAYAK CHAIR IM

(71) Applicant: Hobie Cat Company, Oceanside, CA (US)

(72) Inventors: Gregory Scott Ketterman, Oceanside, CA (US); James Taylor Czarnowski, Fallbrook, CA (US); Jason Christopher Kardas, Vista, CA (US); Philip James Dow, Oceanside, CA (US); Drew William Brackett, Oceanside, CA (US)

(73) Assignee: Hobie Cat Company, Oceanside, CA (US)

( * ) Notice: Subject to any disclaimer, the term of this patent is extended or adjusted under 35 U.S.C. 154(b) by 0 days.

(21) Appl. No.: 14/792,012

(22) Filed: Jul. 6, 2015

(65) Prior Publication Data

US 2016/0023726 A1 Jan. 28, 2016

Related U.S. Application Data

(60) Provisional application No. 62/028,496, filed on Jul. 24, 2014.

(51) Int. Cl.
*B63B 35/71* (2006.01)

(52) U.S. Cl.
CPC ..... *B63B 35/71* (2013.01); *B63B 2035/715* (2013.01)

(58) Field of Classification Search
CPC ..... B63B 35/71
See application file for complete search history.

(56) References Cited

U.S. PATENT DOCUMENTS

| | | | |
|---|---|---|---|
| 53,415 | A | 3/1866 | Cole |
| 2,644,177 | A | 7/1953 | Stanley |
| 4,768,454 | A | 9/1988 | Selken |
| 4,843,999 | A | 7/1989 | Kobus et al. |
| 5,513,900 | A | 5/1996 | Iglesias |
| 5,622,403 | A | 4/1997 | Gonda |
| 5,651,706 | A | 7/1997 | Kasper |
| 6,065,422 | A | 5/2000 | Davidson et al. |
| 6,311,632 | B1 | 11/2001 | Noel, Jr. |
| 6,736,084 | B2 | 5/2004 | McDonough et al. |
| 6,827,396 | B1 | 12/2004 | Jewell |
| 6,925,955 | B1 | 8/2005 | Brooks |
| 8,387,940 | B2 | 3/2013 | Gros |
| 8,651,576 | B2 | 2/2014 | Farber |

(Continued)

FOREIGN PATENT DOCUMENTS

| | | | |
|---|---|---|---|
| CN | 1642774 | A | 7/2005 |
| EP | 0781681 | A2 | 2/1997 |

(Continued)

*Primary Examiner* — Stephen Avila
(74) *Attorney, Agent, or Firm* — Joseph E. Mueth, Esq.

(57) ABSTRACT

A watercraft having a seat securely carried on the watercraft, the seat having a plastic seat frame and a plastic seat back frame. The seat frame and the seat back frame are joined via a hinged connection. The bottom of the seat frame has receptacles that easily engage with engagement elements mounted on the deck of the watercraft. The seat has mechanism to easily adjust the height of the front of the seat, the height of the rear of the seat, the recline angle, and the amount of lumbar support. The seat has four legs stored under the seat frame which can be plugged into the seat frame to turn the seat into a lawnchair.

18 Claims, 18 Drawing Sheets

(56) References Cited

U.S. PATENT DOCUMENTS

| | | | | |
|---|---|---|---|---|
| 2004/0140705 | A1* | 7/2004 | McMillen ..... | B60N 2/20 297/378.1 |
| 2004/0256894 | A1 | 12/2004 | McManus et al. | |
| 2006/0202533 | A1 | 9/2006 | Goodman | |
| 2008/0060569 | A1 | 3/2008 | Howard | |
| 2008/0283105 | A1 | 11/2008 | Dubose, III | |
| 2009/0038526 | A1 | 2/2009 | Walton | |
| 2009/0038529 | A1 | 2/2009 | Walton | |
| 2010/0156159 | A1 | 6/2010 | Adams et al. | |
| 2012/0017821 | A1 | 1/2012 | McDonough | |
| 2013/0125807 | A1 | 5/2013 | Farber | |
| 2013/0239873 | A1 | 9/2013 | Dow et al. | |

FOREIGN PATENT DOCUMENTS

| | | | |
|---|---|---|---|
| GB | 2270283 | A | 3/1994 |
| JP | 2008094168 | A | 4/2008 |

* cited by examiner

ADJUSTABLE KAYAK CHAIR IM

Applicants claim the benefit of U.S. Provisional Patent Application 62/028,496, filed Jul. 24, 2014.

BACKGROUND OF THE INVENTION

Various seating arrangements are known to be used on kayaks and other small pleasure craft. For example, Selkin, U.S. Pat. No. 4,768,454 and Hopkins & Holloway, Limited, UK Pat. App. No. GB 2 401 539 A disclosed portable seats for boats. Dow, et. al. U.S. Pat. App. Pub. No. 2013/0239873 A1 and Pyranha Mouldings Limited, UK Pat. App. No. GB 2 331 235 A disclose seat back adjustment arrangements used in watercraft. It is desirable that the seat be both comfortable and secured to the watercraft. This invention provides a novel chair which is adapted to be firmly secured to a watercraft while also being adjustable in multiple ways to suit a variety of preferences.

SUMMARY OF INVENTION

Briefly, in one aspect, the invention comprises a watercraft comprising:

an upper surface, a seat securely carried on said surface, spaced apart vertical racks secured to a vertical surface of said watercraft beside said seat, an elongated member extending transversely with respect to the longitudinal dimension of said watercraft between said racks and having pinion gears rotatably connected to said elongated member, said racks receiving said pinion gears, means for attaching the front of said seat to said elongated member, and means for locking said pinion gears in any vertical position on said racks, whereby the front of said seat can be raised and lowered by changing the position of the pinion gears on said racks.

The means for locking comprises a spring within said elongated member connected to a pin, a vertical plate aligned with each said rack and having a series of vertically disposed holes therein for receiving the end of said pin, said spring biasing said pin through said pinion gears and vertically disposed holes, means for overcoming said spring bias including a manually operated element whereby when said manually operated element is operated, said pin is withdrawn from said vertical plates and said pinion gears are free to travel up and down the racks to change the height of the front of the seat and when said manually operated element is released, the pin engages one of said holes and locks the seat in place.

In another aspect, the present invention comprises a watercraft having a chair with seat securely carried on said watercraft;

said chair having a frame and comprising a seat frame, a back frame, said seat and back frames being joined via a hinged connection, the frames of both said seat and said back having material extending across the frame to provide a supported seating area and back support area, the underside front of said frame having two receptacles, the upper surface of said watercraft having secured thereto two spaced apart engagement elements for receiving said receptacles and engagement elements being shaped such that the receptacles can be inserted into and removed from the engagement elements only when the rear of the seat is rotated upwardly and forwardly about said engagement elements, said engagement elements and receptacles being locked together when the seat is rotated downwardly and rearwardly.

A watercraft comprising:

a deck surface, a cockpit, a seat secured to said cockpit, a support element pivotally attached to the bottom rear of said seat and having a distal end, a spring to hold the support element in a stowed position beneath said seat, a means for pivotally deploying said support element, said cockpit having multiple vertically disposed notches on a generally upright surface adjacent the rear of said seat, to receive the distal end of said support element when deployed and support the rear of said seat at multiple heights.

In an additional aspect, the present invention comprises a watercraft comprising:

a seat securely carried on said watercraft, said seat having a seat frame and seat back frame pivotally connected to said seat frame, said seat back frame supported by a cord member on either side of said seat back frame, means on said seat back frame for tensioning said cord member to pull said seat back frame forward, said seat back frame having locking means to lock said tensioning means, said seat back frame having a manually operated means, such as a lever, coupled to release said locking means.

In another additional aspect, the present invention comprises a watercraft comprising:

a seat securely carried on said watercraft, said seat having a seat frame and seat back frame, said seat back frame having fabric extending across to provide back support, a nonrigid rod attached to said fabric on each side, said seat back frame comprising rigid channels on each side, said seat back frame having means to draw said rods into said channels to a desired depth to increase or decrease the tension in said fabric across said seat back frame.

The present invention also comprises a watercraft comprising:

a seat securely carried on said watercraft, said seat having a frame, four tapered holes in proximity to the underside of the corners of said frame, four legs each having upper and lower ends, the upper ends being adapted to be removably receivable and held in said tapered holes, tension cords passing through each leg, one of end of said cord being attached at the underside of said frame, the other end being attached at the lower side of said leg, holding means associated with each leg to hold said leg in stowed position beneath said frame, said tension cords pulling the upper end of said legs toward said tapered holes when said holding means are released, allowing said upper end of said legs to be secured in said tapered holes and allowing manual withdrawal of said legs from said holes by applying tensioning force to said tension cords and allowing said legs to be returned to the stowed position.

Turning in more particularly to some of the features of the present invention, the engagement elements, typically key-like engagement elements, are attached to an elongated member, normally a tube, that extends transversely across the upper surface of the watercraft. The engagement elements are free to rotate on the tube, but the engagement elements are constrained to stay upright by a rack at each end of the tube. At each end of the tube is a pinion gear which engages teeth on the rack. The rack constrains the tube and gears to roll up and down inside the rack. The benefit of this feature is the tube is constrained to stay horizontal. If a load is applied to one end of the tube, torque is created in the tube and the gears force the tube to remain horizontal. Also the rider typically pushes back on the seat and the gear rolls up and down on the rack which reduces friction. Inside the left end of the tube is a spring loaded pin. Inside the rack on the left side is a stainless steel plate with seven holes. The spring pushes the pin into one of the holes. When the pin is engaged in a hole in the stainless steel plate, the pin prevents the tube from moving up or down or spinning and the gears hold the tube at the selected height.

The rear of the seat frame has a support element, serving as a type of kickstand, that is pivotally mounted to the seat frame. A spring produces a torque on the support element which holds the support element up and out of the way in the stowed position. A small rope on the left side will cause the support element to rotate down into the deployed position. The support element has two legs. These legs can rest on a notch in the deck of the watercraft for the upper seating position or the legs can rest in a notch on the floor of the watercraft for the medium position. For the low position the seat frame rests on the floor of the watercraft.

The back rest frame is supported with a line on either side of the watercraft. The length of the line can be adjusted to adjust the recline position of the seat back frame. The line on the left side enters the seat back frame and a sheave turns the line 90° so the line is lead to the center. The line on the right side enters the seat back frame and a sheave turns the line 90° toward the center. A sheave on the left side turns the line 180° back to the center. Both lines are then tied to the linear gear. The linear gear has twenty-nine teeth that engage six teeth on the catch. The catch has two angled slots such that when the catch moves to the left two pins force the catch to press onto the linear gear and the teeth engage. The catch will hold the linear gear in that position. A spring applies force to the catch that will keep the catch engaged with the linear gear. To disengage the catch there is a manually operated means such as a lever on the right side of the seat back frame that will pull the catch to the right and disengage the catch from the linear gear. A shock cord applies a force to the linear gear that pulls the linear gear to the right and creates tension in the lines. This tension will pull the seat back forward. Pressure from the operator's back will push the seat back and stretch the shock cord. The seat frame and the back frame are preferably made of a light weight material such as plastic.

The lumbar support can be adjusted. The tension in the fabric supported by the seat back frame can be adjusted in the area of the lower back. A stainless steel rod is attached to each side of the fabric for the seat back frame. On each side of the seat back frame there is a channel that the stainless steel rod is placed. At the height of the lower back a line is wrapped around the stainless steel rod and tension in the line will pull the stainless steel rod into the channel which will increase tension in the fabric. A small tensioner is mounted to the seat back frame which can increase the tension in the line and thus increase the tension in the fabric.

The seat bottom frame has four tapered holes. Stowed with a loop of shock cord are four legs. When the leg is released a second shock cord pulls the leg into the tapered hole. The leg has a taper to match the taper of the hole. The four legs allow the seat to be used on the ground as a lawn chair.

The seat of this invention meets the needs of recreational and fishing kayakers in significant respects. The seat is comprised of a frame connected through a pivot to a seat back frame. The seating material is fixed to these frames to allow for comfortable distribution of the user's weight on the seat. This seating material is designed to allow air to pass through, and not to hold water which helps to keep the user dry and cool. There is also a three dimensional mesh integrated into the seating material to increase the airflow and decrease the pressure points.

The seat has four adjustments; the recline angle of the seat back frame, the lumbar support, the height of the front of the seat and the height of the rear of the seat. The up position allows for a better line of sight into the water for fishing or nature watching. The lower position offers a lower center of gravity and therefore more stability in the small boat. The front of the seat assembly is attached to the watercraft via a key on the watercraft which engages a receptacle on the bottom of the seat frame design that allows the seat assembly to rotate while remaining fixed to the watercraft. This pivoting action along with a rear support element arrangement allow for the up and down seating functionality. This key and receptacle design also allows for very quick attachment and removal of the seat to the watercraft. Out of the watercraft, the seat can be used as a fully functioning chair after legs are installed.

The invention is applicable to watercraft of the small pleasure craft type generally. One of the most typical of these watercraft is the kayak.

THE DRAWINGS

FIG. 1 is a perspective view of the front upper right side of the seat.

FIG. 1*a* is a perspective view of the front upper right side of the seat installed in a kayak.

FIG. 2 is a perspective view of the rear upper right side of the seat.

FIGS. 3*a* and 3*b* are a cutaway cross sectional view of the right key engaging the receptacle of the bottom of the seat frame.

Figure 5:
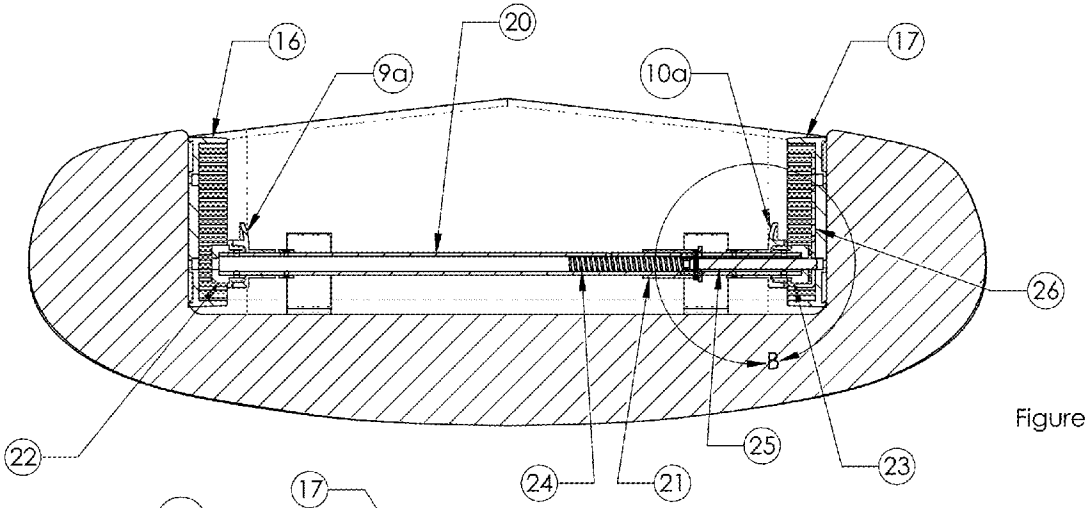
FIG. 5 is a cross section view of FIG. 4 through the aluminum tube looking aft.
Figure 5A:
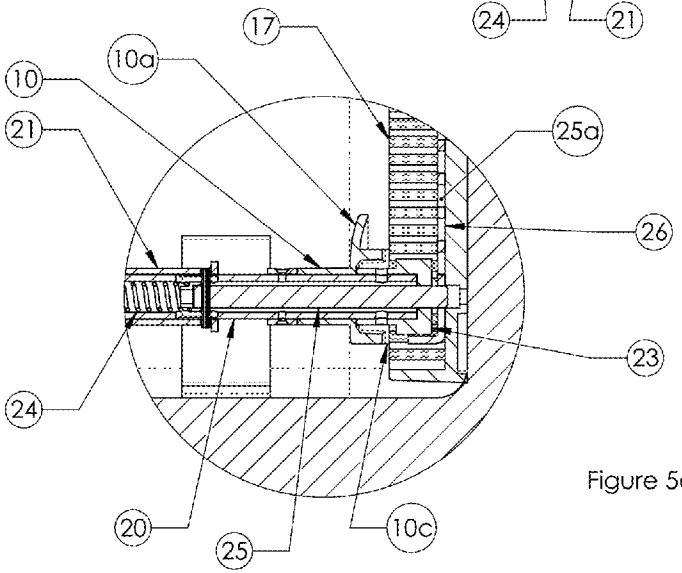

FIG. 5*a* is an enlarged view of the right hand end of FIG. 5 indicated by "B".

Figure 6:
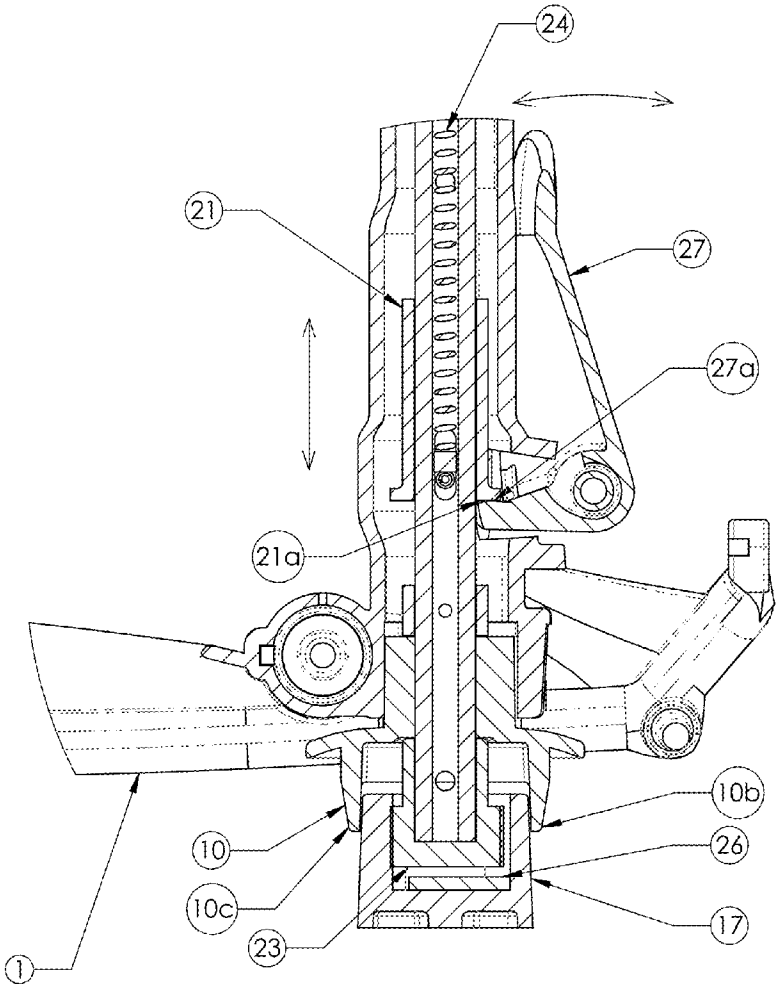

FIG. 6 is a cross sectional view of the front left corner of the seat frame looking up at the release lever, a manually operated means.

Figure 7:
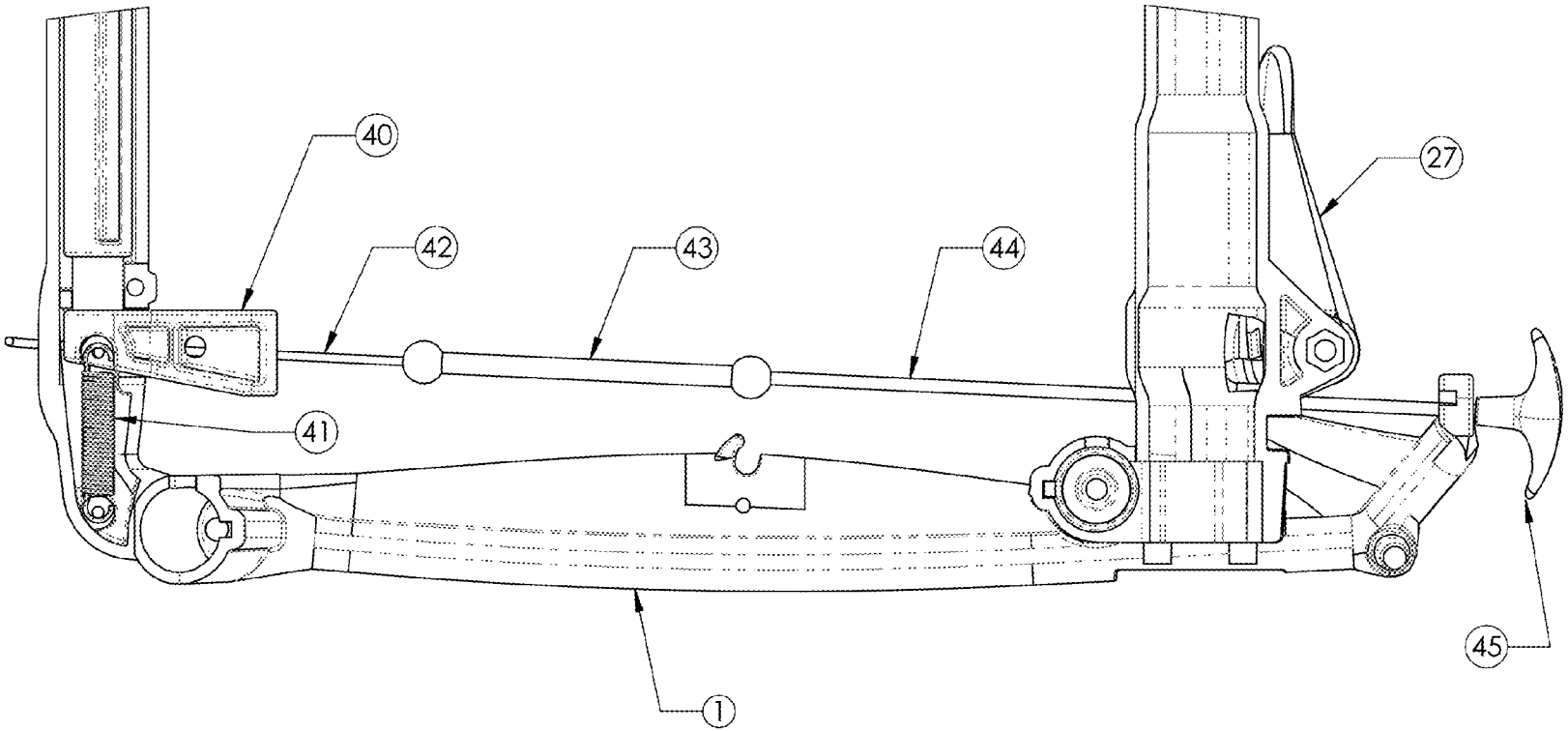

FIG. 7 is a bottom view of the left side of the seat frame showing the support element deploying line.

Figure 8A:
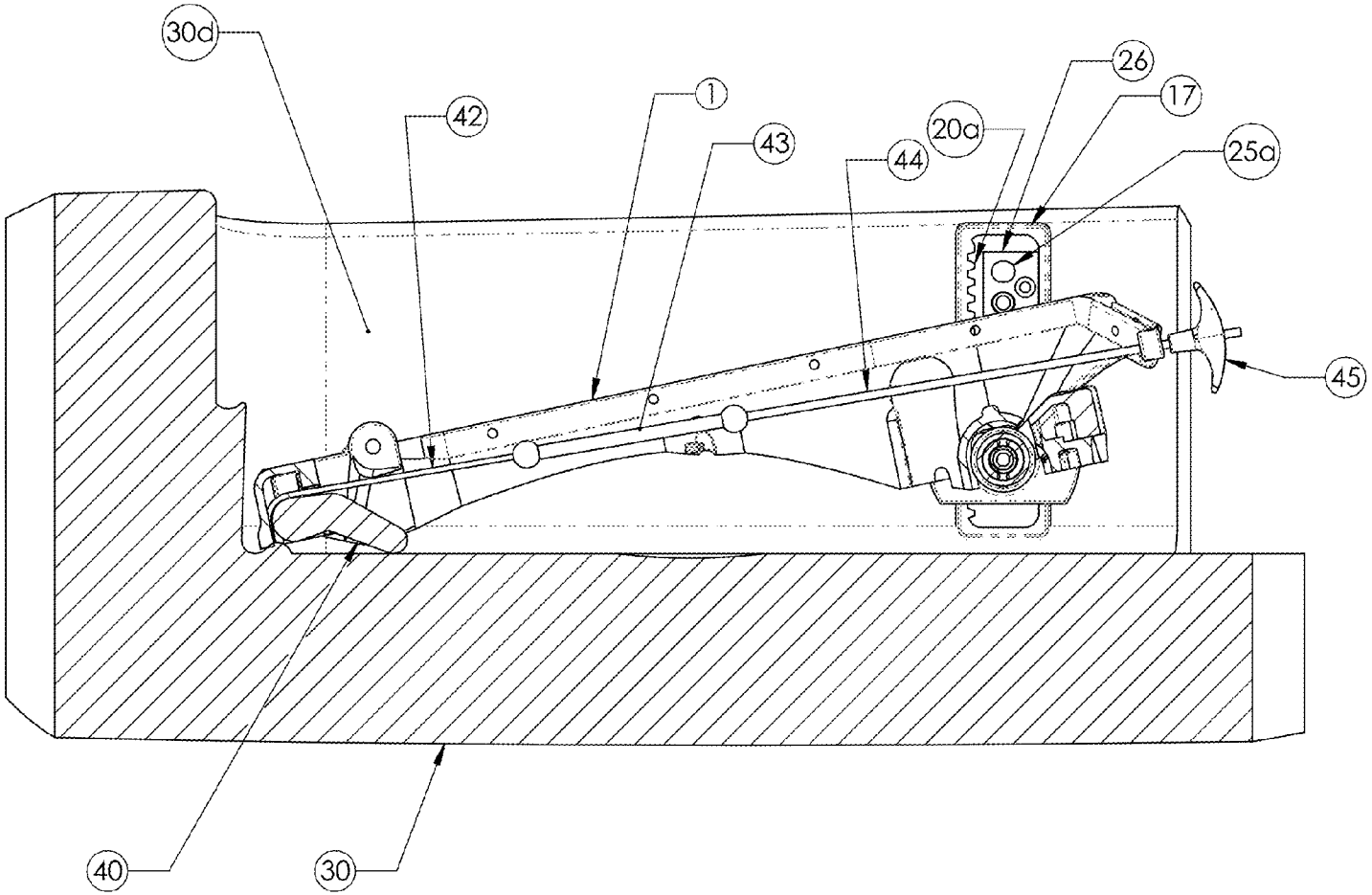
Figure 8B:
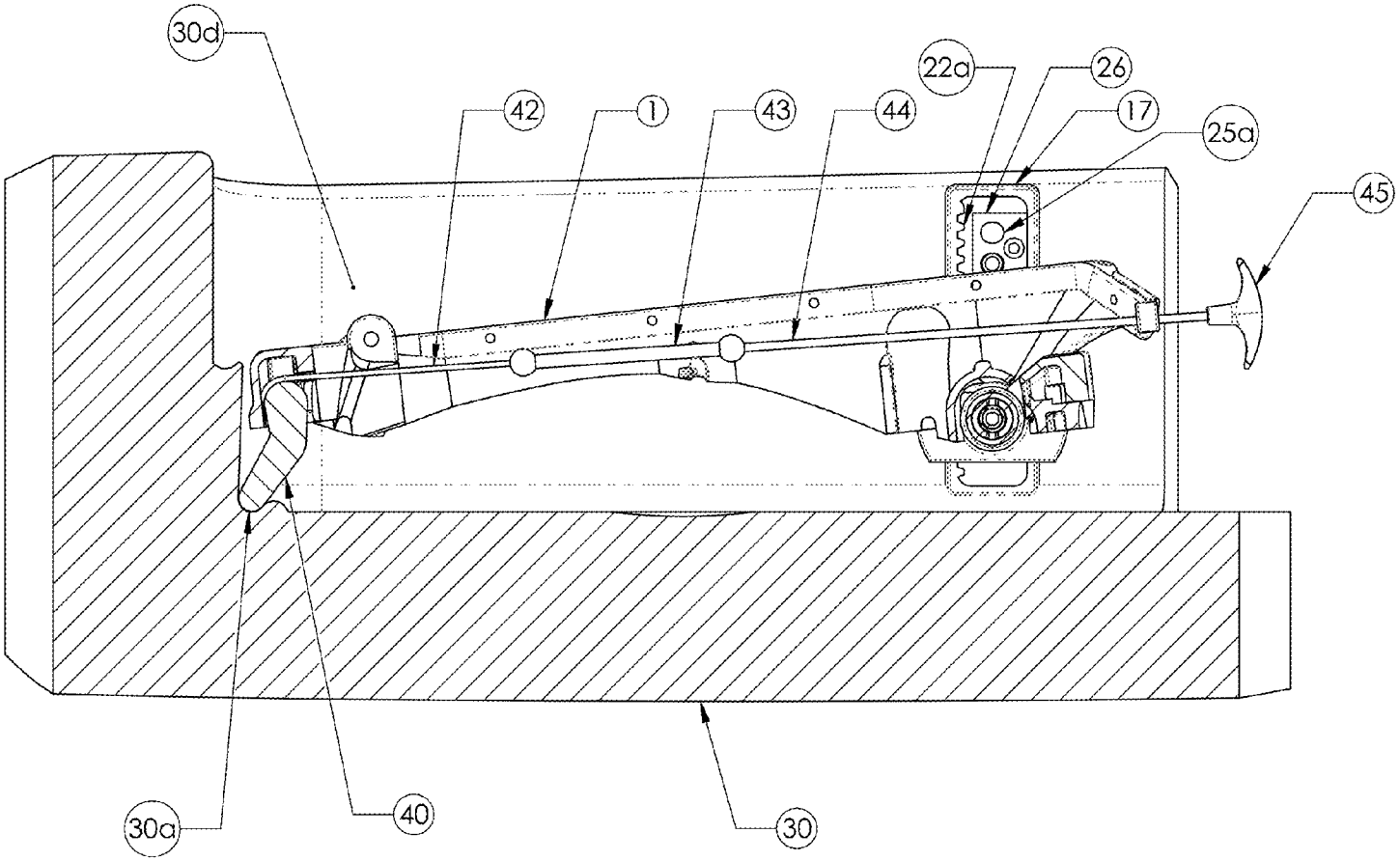
Figure 8C:
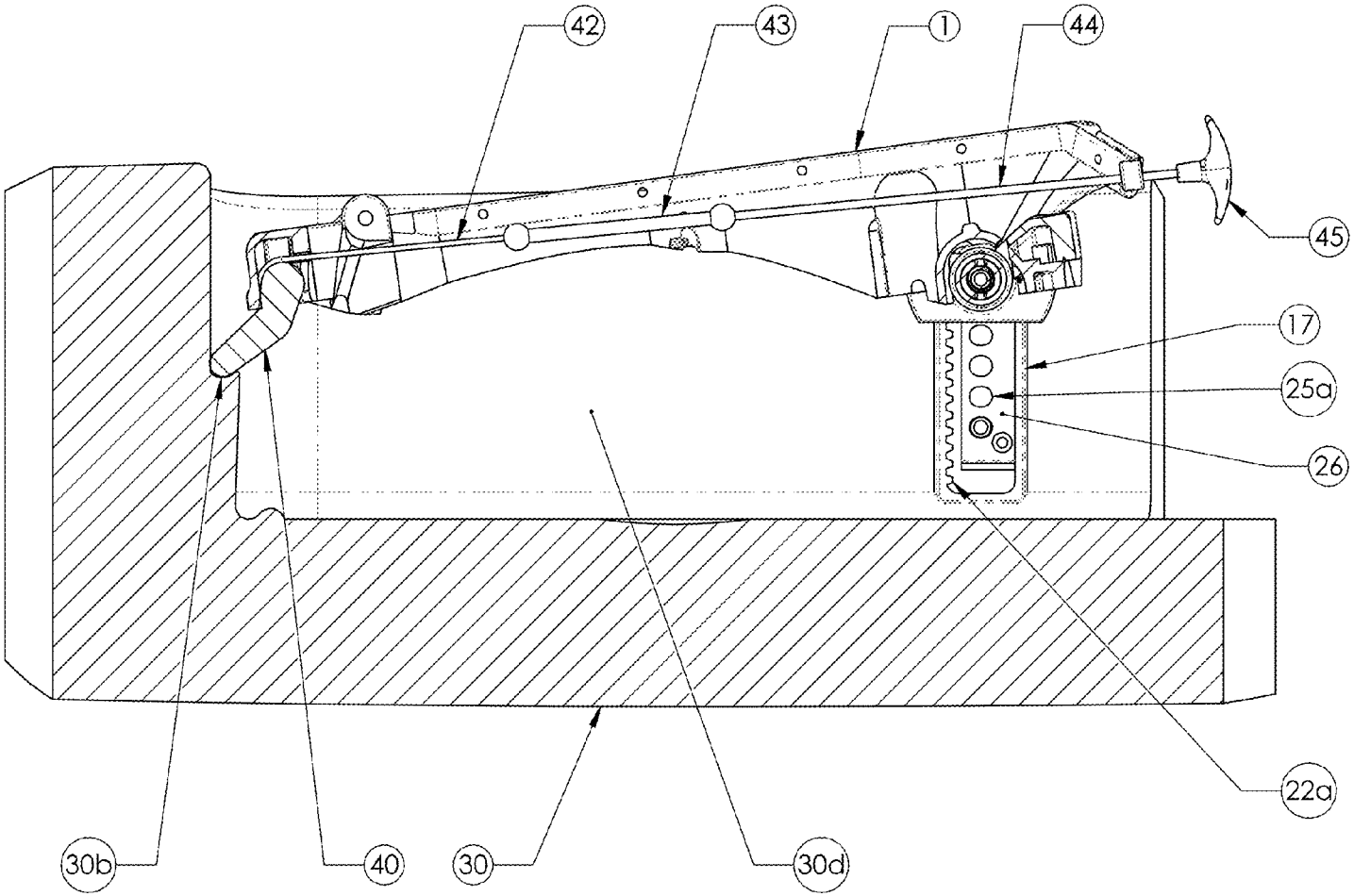

FIGS. 8*a*, 8*b*, and 8*c* show a cross sectional view of the seat in the kayak looking to the left showing the support element in the low position, the medium position, and the high position.

Figure 9:
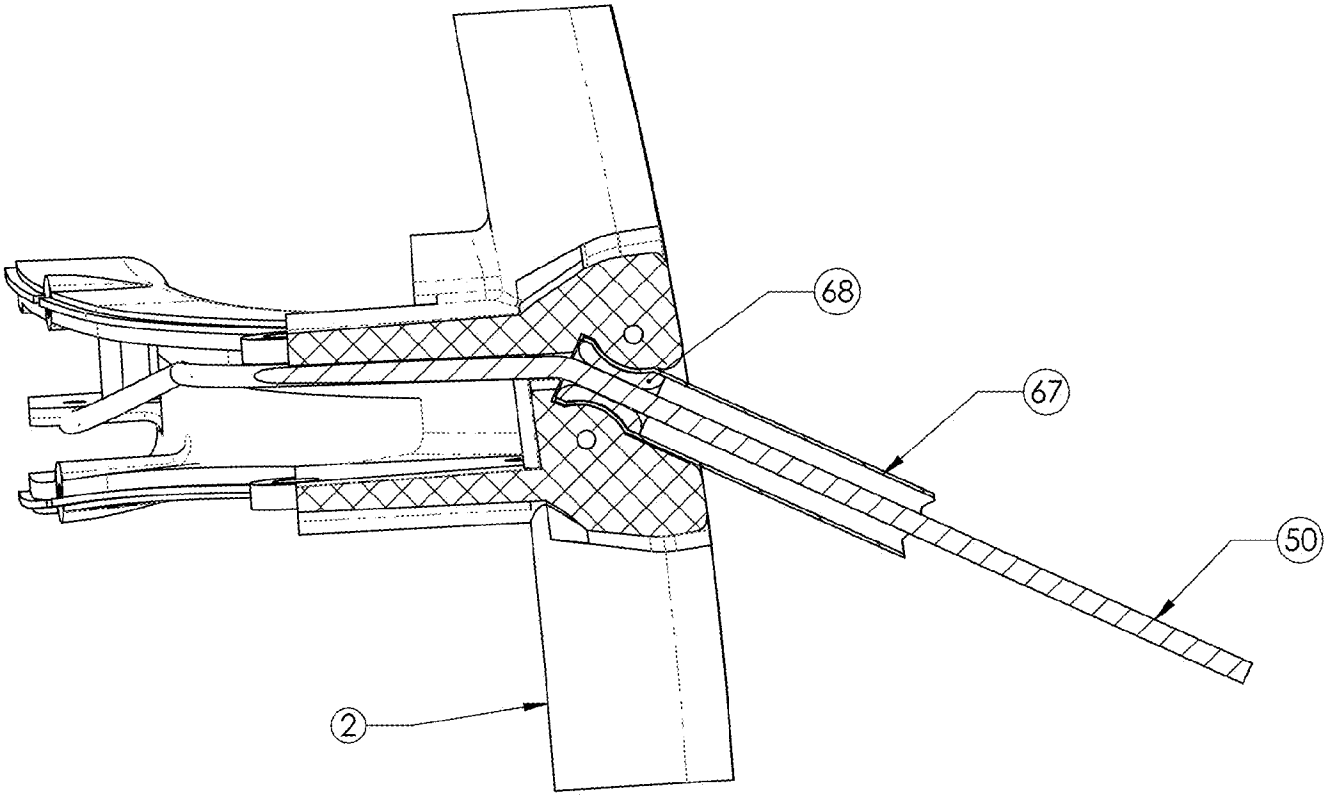

FIG. 9 is a cross sectional view of the spectra line supporting the seat back frame.

Figure 10:
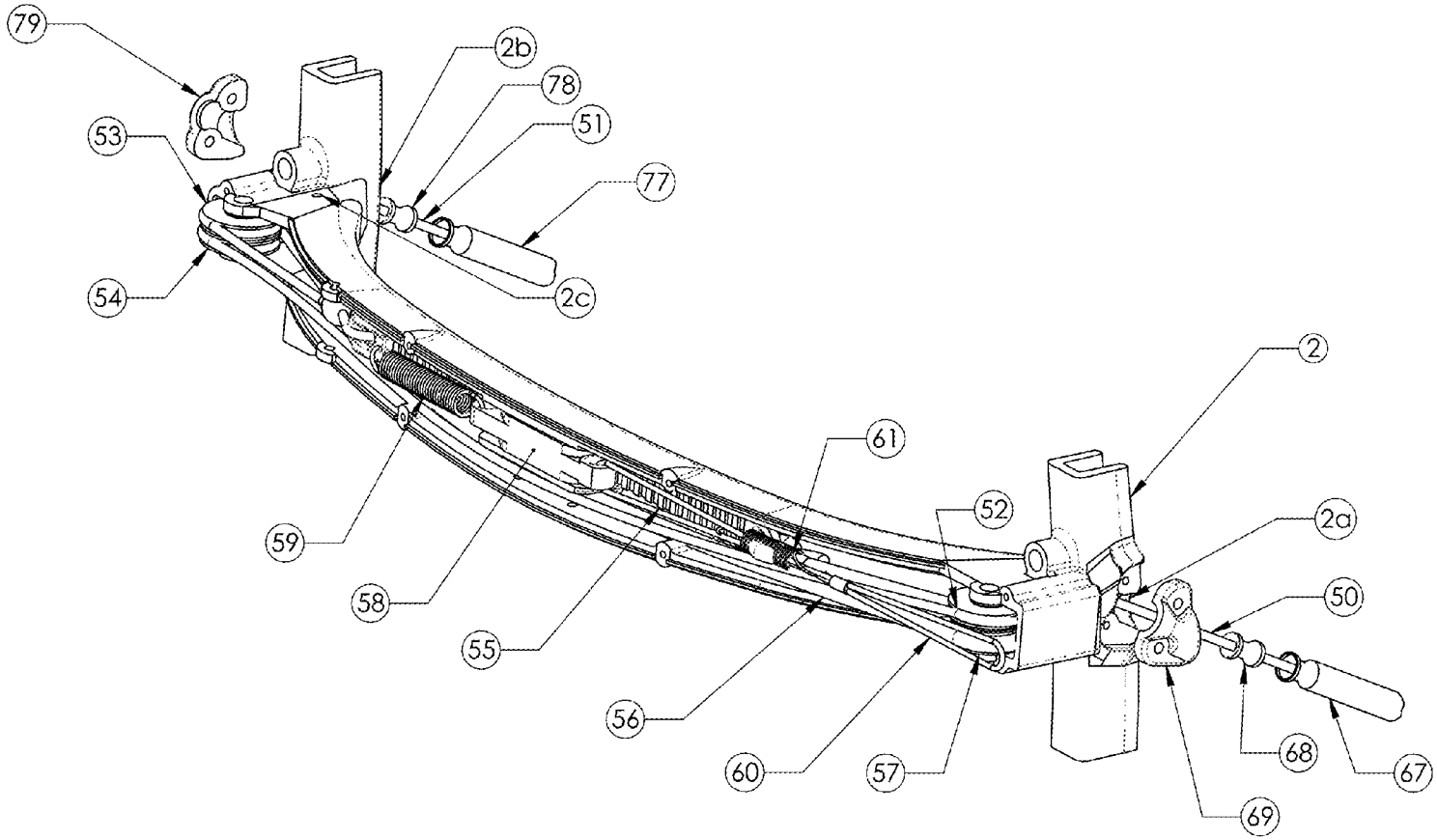

FIG. 10 is a perspective view of the rear upper right side of the recline adjuster mechanism with the cover removed.

Figure 10A:
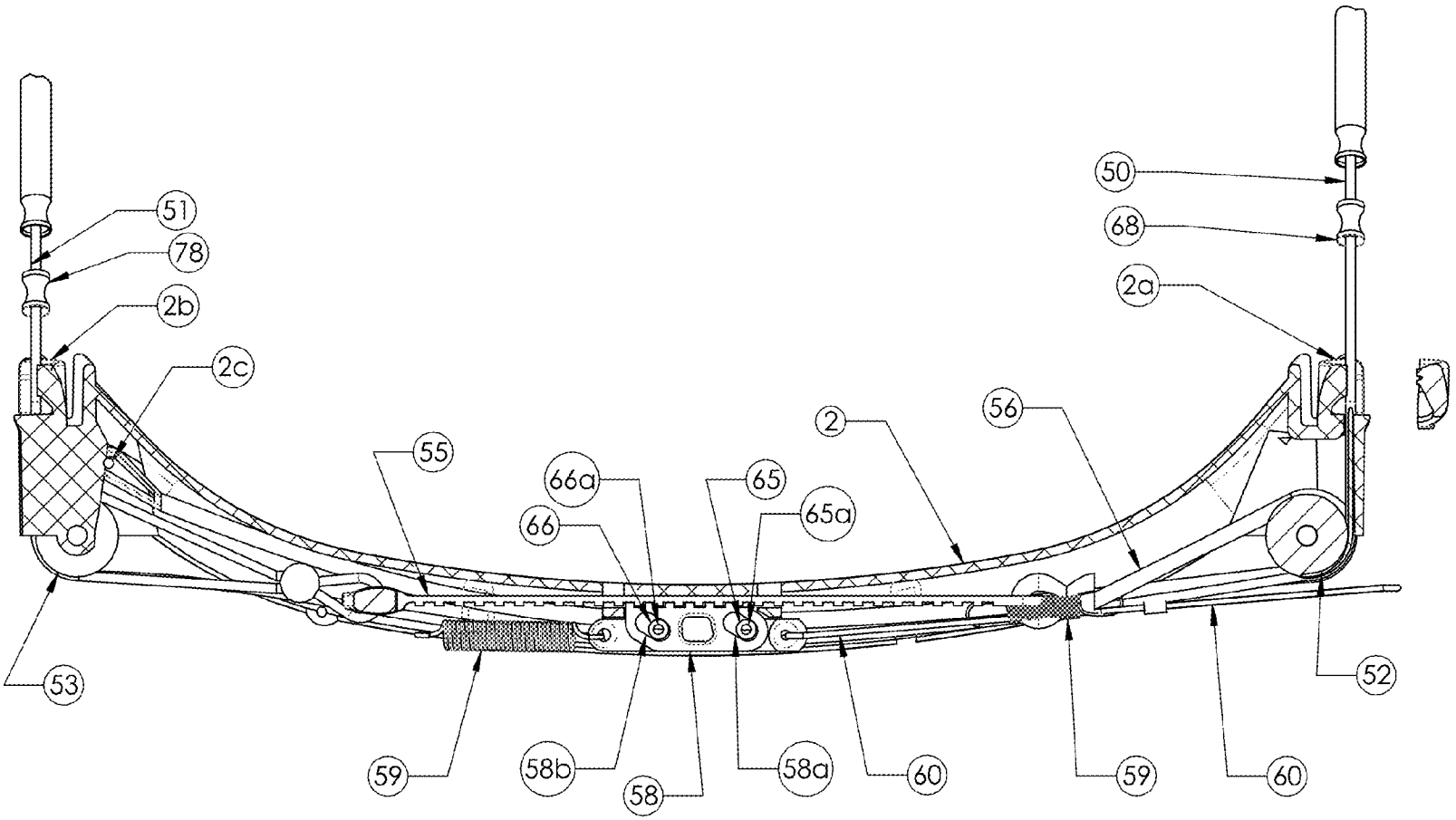

FIG. 10*a* is a cross sectional view through the recline adjuster mechanism looking down.

Figure 10C:
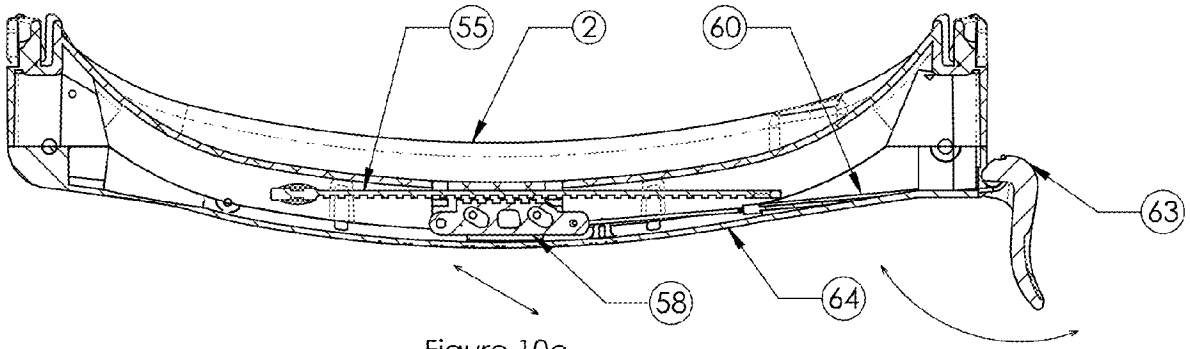
Figure 10B:
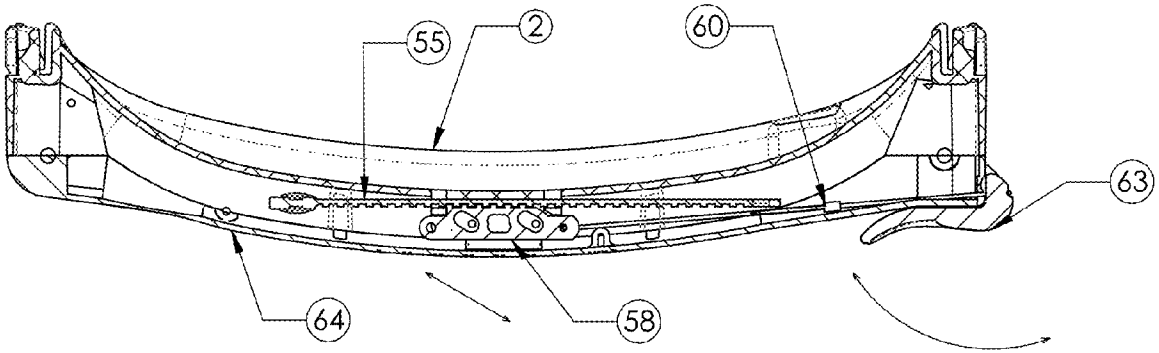

FIGS. 10*b* and 10*c* show cross sectional views of the recline adjuster with the catch in the engaged and disengaged positions.

Figure 11A:
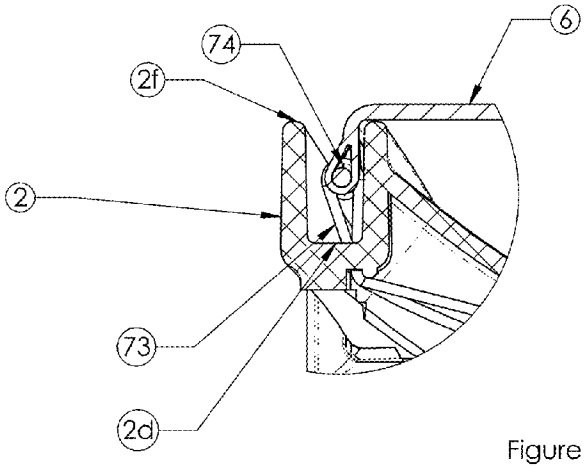
Figure 11:
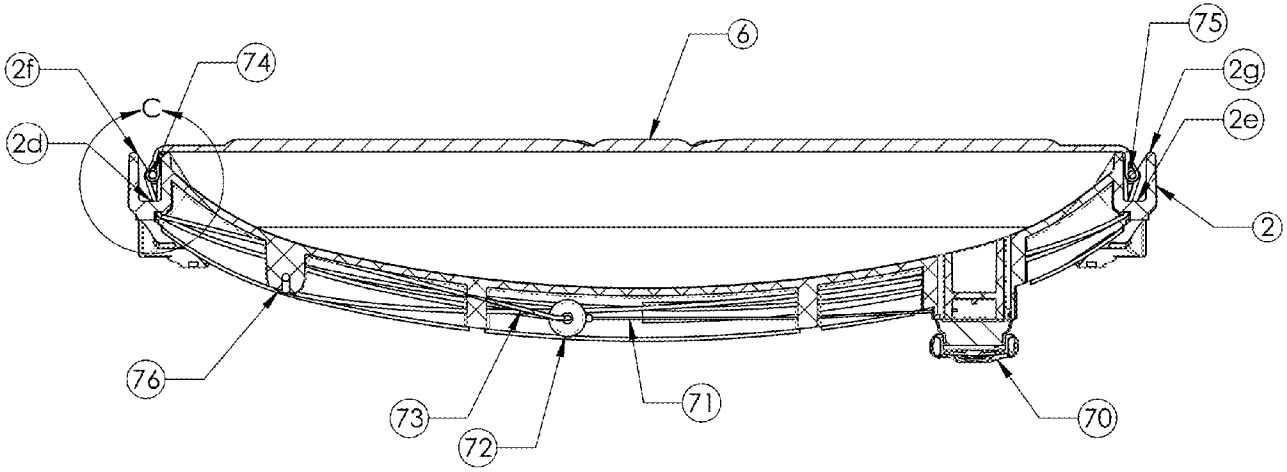

FIGS. 11 and 11*a* are a cross sectional view of the lumbar adjuster looking down.

Figure 12:
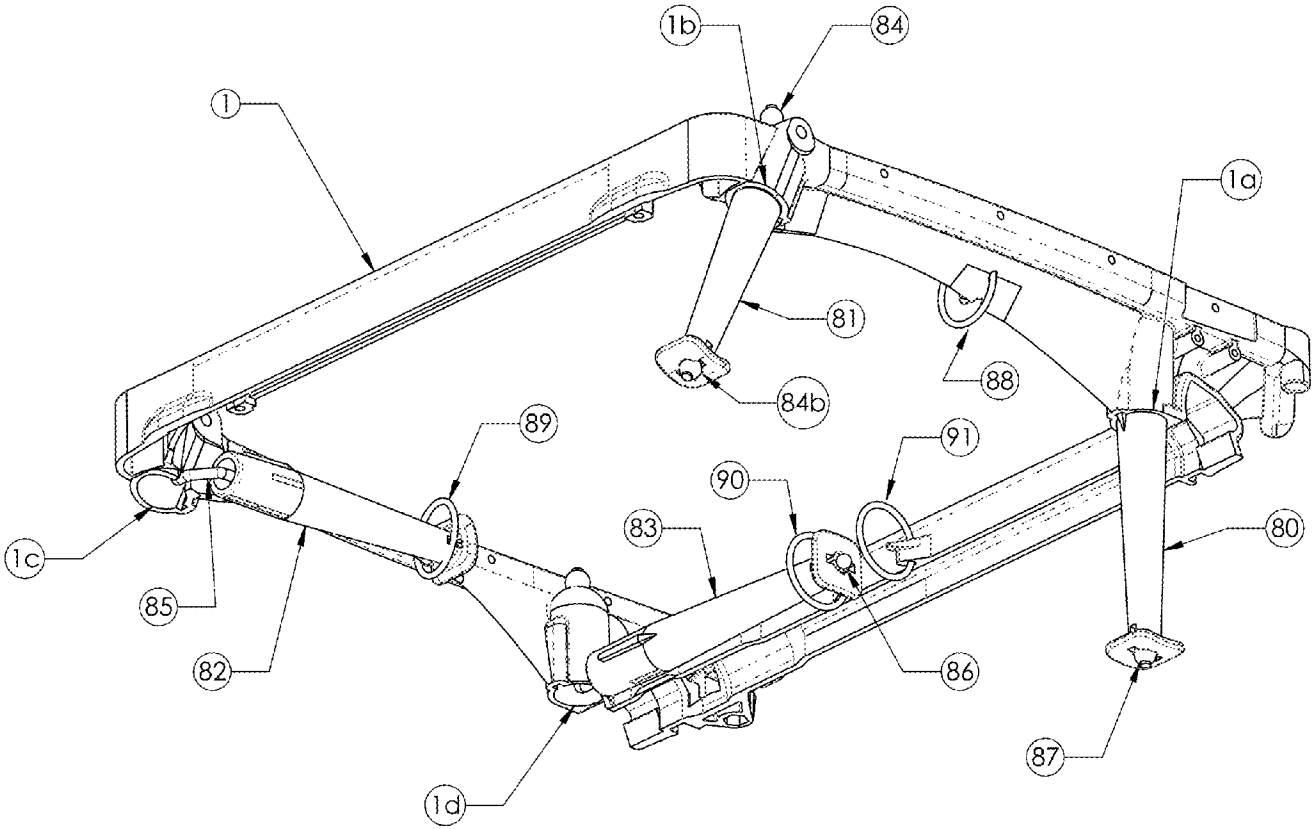

FIG. 12 is a perspective view of the rear lower right side of the seat frame with the legs.

Figure 13:
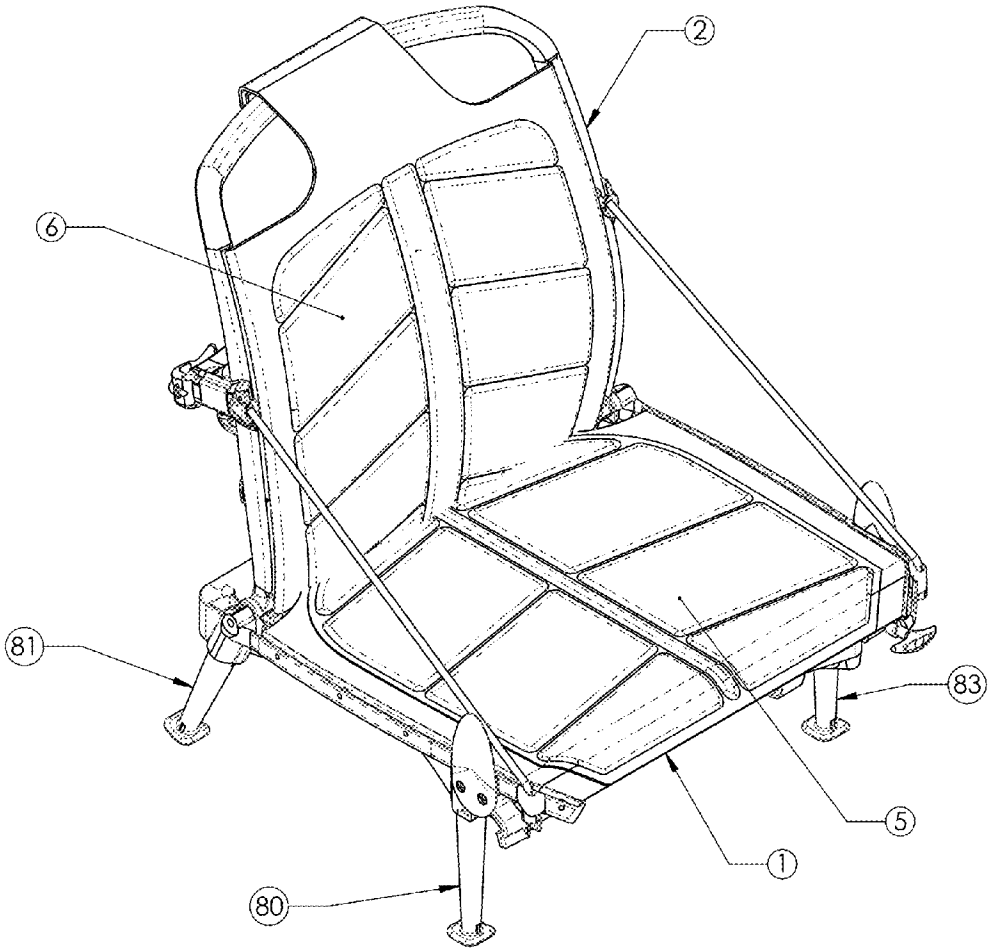

FIG. 13 is a perspective view of the front upper right side of the seat with the legs installed.

DESCRIPTION OF PREFERRED EMBODIMENTS

Figure 1:
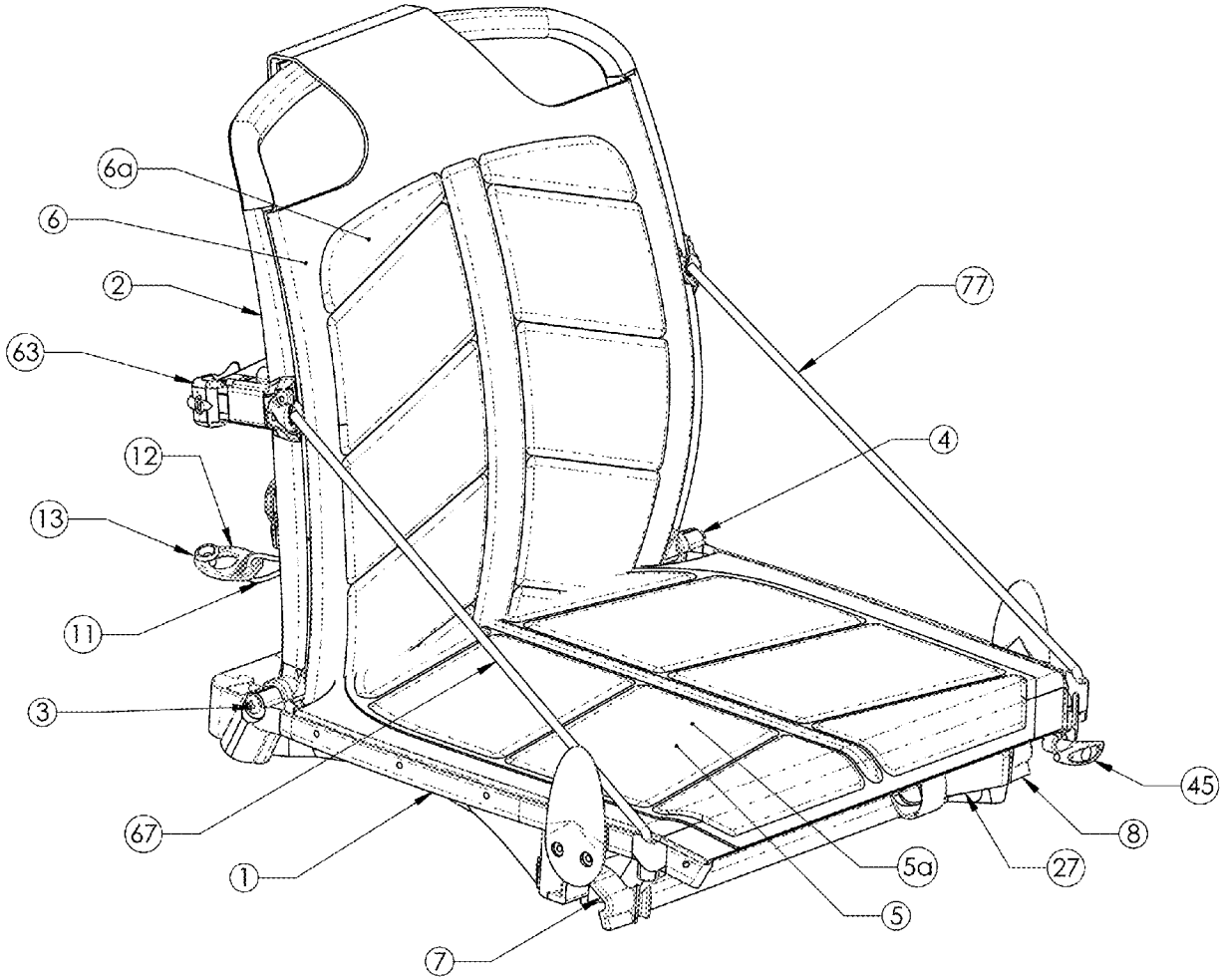
Figure 2:
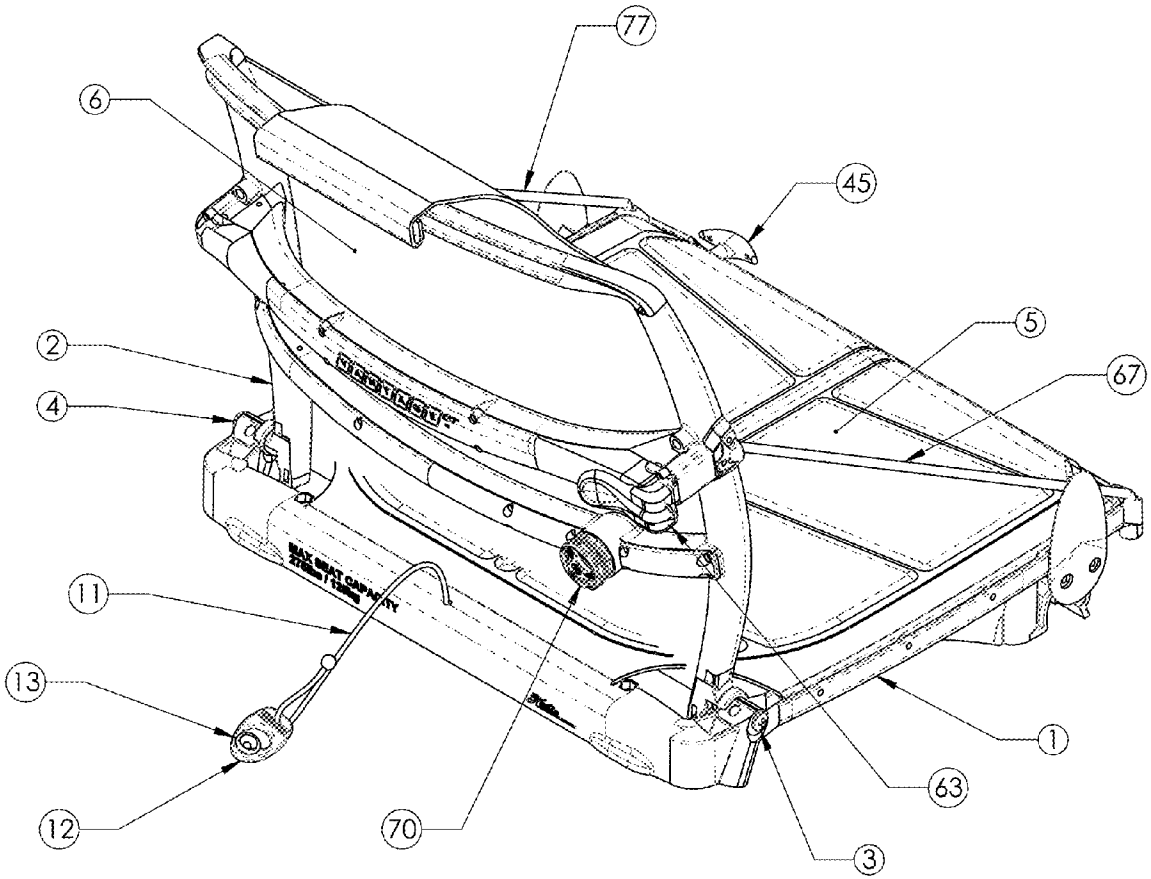

Turning to the drawings in more detail, FIGS. 1 and 2 shows the plastic seat frame 1, a plastic seat back 2 which are pivotally connected by bolt 3 and 4. The seat mesh 5 a waterproof material is attached to seat frame 1 to create a seating area 5*a*. Similarly, the seat back mesh 6, a waterproof material is attached to the seat back frame 2 to create a seating area 6*a*.

Figure 1A:
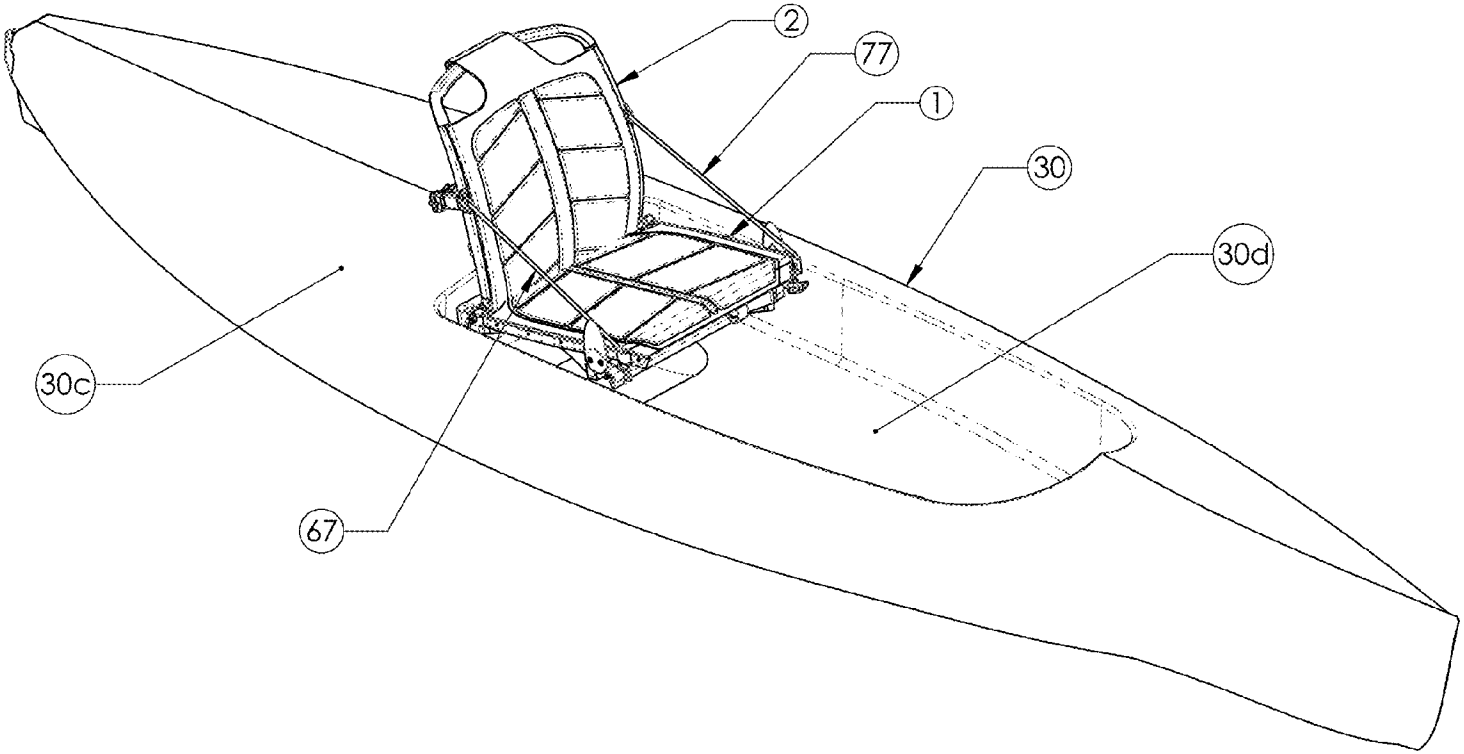

FIG. 1*a* shows the seat installed in watercraft 30 having a deck 30*c* and cockpit 30*d*.

Figure 3B:
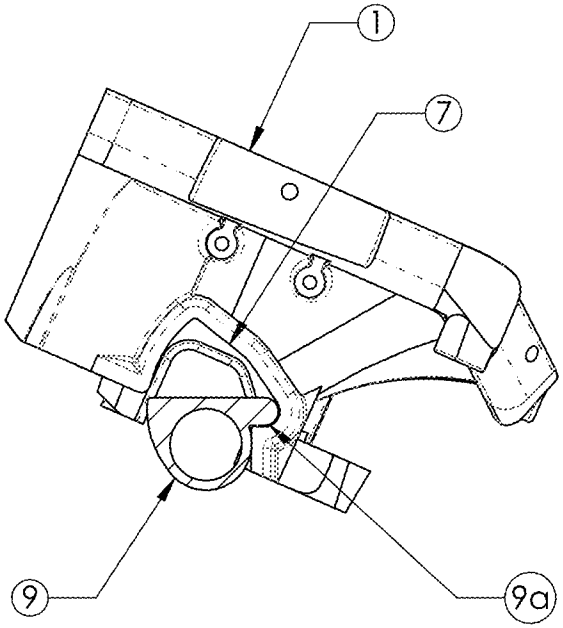
Figure 3A:
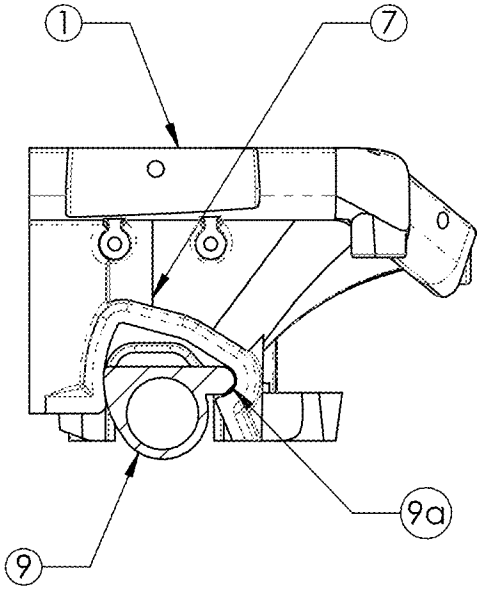

FIGS. 3*a* and 3*b* show cut away view of the seat frame 1 which has receptacle 7 on the bottom of the front right side. FIG. 1 shows the receptacles 7 and 8 at each of the undersides of the front corners of the seat frame. The receptacles 7 and 8 are shaped to receive engagement elements 9 and 10, respectively. These elements in the embodiment shown are key-like and are herein referred to as keys. The key 9 has a forward facing ledge 9*a* that engages the receptacle 7 when the seat is pitched upwardly and forwardly about the keys approximately 45° as shown in FIG. 3*b*. As the chair is pitched up the key 9 is locked in the receptacle 7 of the seat frame 1 as shown in FIG. 3*a*. FIG. 2 shows cord 11 attached to seat frame 1 and clip 12 attached to the end of the cord 11. Clip 12 can be snapped onto eyelet post 13 which is fixed to the hull 30 and then the seat frame 1 cannot pitch forward to the point where the keys 9 and 10 cannot disengage from the receptacles 7 and 8 and the chair is securely fixed to the watercraft.

Figure 4:
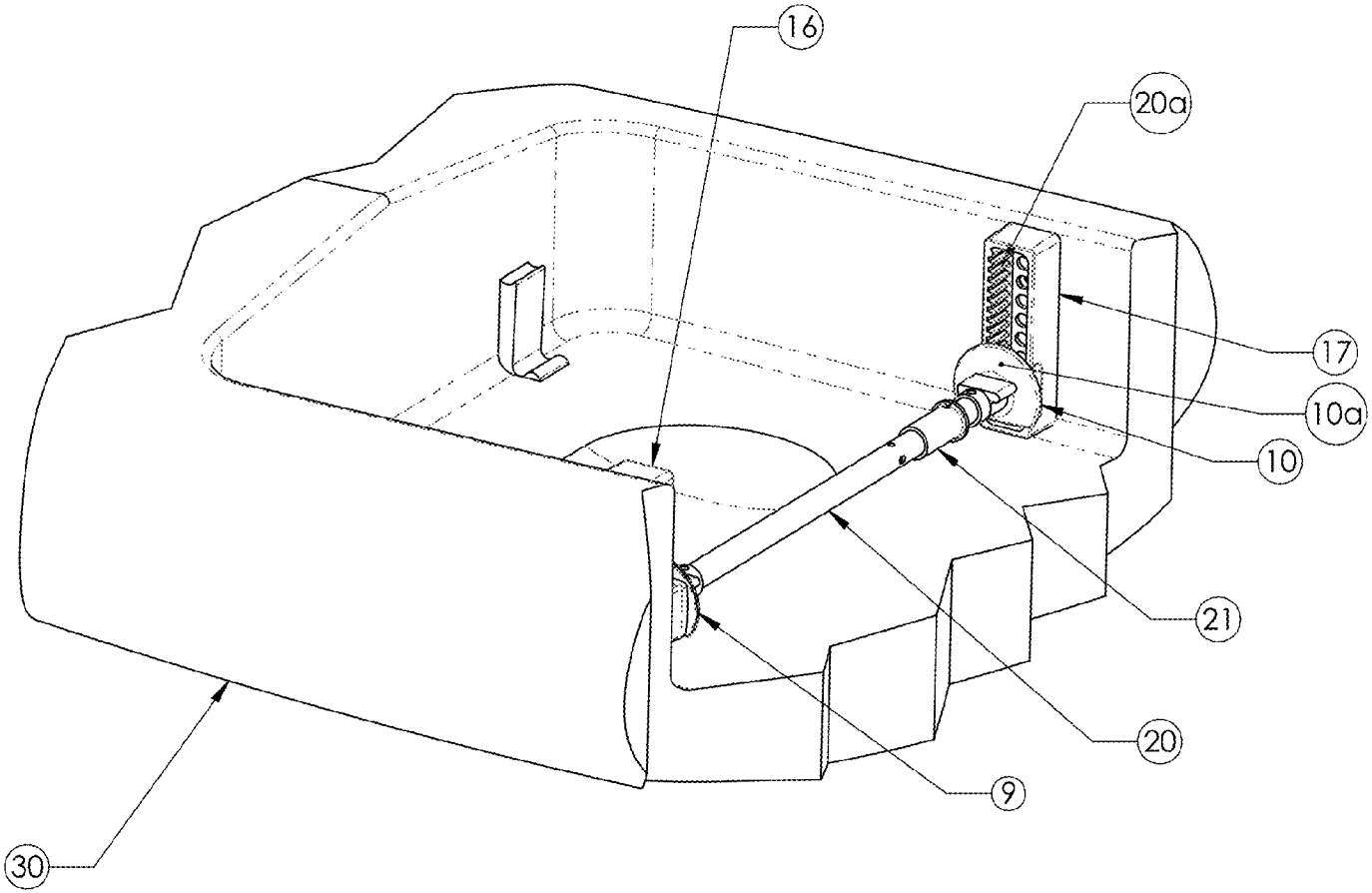
FIG. 4 is a perspective view a cutaway section of the kayak showing the aluminum tube, the keys and racks.

FIG. 4 shows the keys 9 and 10 mounted to the aluminum tube 20 which engages the racks 16 and 17 and prevent the keys from rotating. Pinion gears 22 and 23 are mounted to each end of the aluminum tube 20 and engage the teeth 20*a* on the racks 16 and 17.

The keys 9 and 10 have vertical members 9*a* and 10*a* which serve to center the seat on the watercraft. The keys also have horizontal projections 10*b* and 10*c* which engage the sides of the racks 16 and 17 to prevent rotation of the keys on tube 20.

FIGS. 5 and 5*a* show a cross sectional view of the watercraft through the tube 20. The spring 24 pushes the pin 25 into one of seven holes 25*a* in plate 26 which locks the seat into the desired height. FIG. 6 shows a cross sectional view looking up at the release manually operated means such as a handle 27 which is in contact with collar 21 at 27*a* and 21*a*. When the release handle 27 is pulled forward the collar 21 compresses spring 24 and withdraws pin 25 from plate 26 and the aluminum tube 20, keys 9 and 10, and pinion gears 22 and 23 are free to move up and down.

FIG. 7 shows a bottom view of the seat frame 1 with the support element 40 pivotally attached. Support element 40 can be a kickstand and is referred to as such in the description of this embodiment. Spring 41 applies a torque to kickstand 40 which causes kickstand 40 to pitch up and remain retracted near the seat frame 1. Line 42 terminates in kickstand 40 and wraps over the top of the kickstand 40. Opposite end of line 42 is tied to shock cord 43 and the other end of the shock cord 43 is tied to line 44 which terminate in handle 45. Pulling the handle 45 forward will cause tension in line 42 which causes the kickstand 40 to pitch down or deploy.

FIG. 8*a* shows sectional view of the seat frame 1 in the hull 30 with the kickstand 40 stowed and the seat in the lowest position. FIG. 8*b* shows the kickstand 40 in the notch 30*a* of the hull 30 which is the medium position. FIG. 8*c* shows the kickstand 40 in the notch 30*b* of the hull 30 which is the high position.

FIG. 9 shows Lines 50 and 51 are covered with a polyester cover 67 and 77 to make them appear more substantial and softer. Ferule 68 and 78 secures polyester cover 67 and 77 to the seat back frame 2 with clamp 69 and 79.

FIG. 10 shows cutaway section of the seat back frame 2 with the cover of the recline adjust 64 removed. The recline position is adjusted by changing the length of the lines 50 and 51 which enter seat back frame 2 at 2*a* and 2*b* and then they are turned approximately 90 degrees by sheaves 52 and 53 toward the center of the seat back frame 2. Line 50 is turned approximately 180 degrees by sheave 54. Both lines 50 and 51 are then terminated to the linear gear 55. Lines 50 and 51 are 1000 lbs breaking strength spectra line. ¼" shock cord 56 is connected to linear gear 55, it is turned approximately 180 degrees by sheave 57 and it is fixed to the seat back frame 2 at 2*c*. Shock cord 56 applies a tensile force to the linear gear 55 and thus to lines 50 and 51. This tension will bring the seat back frame 2 forward if catch 58 is disengaged. Catch 58 is mounted such that movement to the left will cause the catch 58 to engage the linear gear 55. Spring 59 applies a force to the catch 58 to move the catch 58 to the left.

FIG. 10*a* shows a cross sectional view of the seat back frame 2 looking down just above the catch 58 and the linear gear 55. Rollers 65 and 66 carried by pins 65*a* and 66*a* respectively are affixed to the seat back frame 2. The rollers 65 and 66 in the diagonal slots 58*a* and 58*b* in catch 58 constrain the catch 58 to move and disengage from the linear gear 55.

FIG. 10*b* shows cable 60 is looped through the end of catch 58. The opposite end of cable 60 is looped through the release lever 63 with the catch 58 engaged with the linear gear 55. FIG. 10*c* shows release lever 63 rotated which produces tension in cable 60 and moves catch 58 to the right and disengages the catch 58 from the linear gear 55. Spring 61 applies a tension to cable 60 and creates a force which keeps the release lever 63 in the retracted position. Cover 64 covers the mechanism and improves aesthetics.

FIG. 11 shows a sectional view of the seat back frame 2 and seat back mesh 6 through the lumbar adjuster. One end of the tensioner line 71 enters the tensioner 70 and the opposite end of the line attaches to the donut 72. The lumbar adjuster line 73 passes through the donut 72. One end of the lumbar adjuster line 73 passes through the seat back frame 2 at 2*d*, makes a 180 degree turn around ⅛" stainless steel wire 74 and returns through the seat back frame 2 at 2*d*. The other end of the lumbar adjuster line 73 makes a 180 degree turn around sheave 76, passes through the seat back frame 2 at 2*e*, makes a 180 degree turn around ⅛" stainless steel wire 75 and returns through the seat back frame 2 at 2*e*. Each end of the lumbar adjuster line 71 is then tied together at the center of the seat back frame 2 and lumbar adjuster line 71 creates a single loop. When tension in the lumbar adjuster line 71 is increased by rotation of tensioner 70, the ⅛" stainless steel wires 74 and 75 is pulled down deeper into the channels 2*f* and 2*g* in the seat back frame 2 which increases the tension in the seat back mesh 6 thereby increasing lumbar support.

FIG. 12 shows the bottom of seat frame 1 with front right leg 80 installed, rear right leg 81 installed, rear left leg 82 stowed, and front left leg 83 stowed. The bottom side of seat frame 1 has 4 tapered holes 1*a*, 1*b*, 1*c* and 1*d* for receiving four legs 80, 81, 82, and 83 which allows the seat to be used as a lawn chair. Each leg has shock cord 84, 85, 86, and 87 which passes through each leg 80, 81, 82, and 83 and the tapered holes 1*a*, 1*b*, 1*c* and 1*d* with the end of the shock cord and secured at the upperside of the seat frame. The legs plug snugly into the tapered holes. The other end of the shock cord being attached to the front of the leg which keeps the legs in the installed position and the stowed position. Shock cord loops 88, 89, 90, and 91 secure the legs in the stowed position. FIG. 13 shows all four legs 80, 81, 82, and 83 installed.

What is claimed:

1. A watercraft comprising:

a seat having a frame comprising a seat frame securely carried on said watercraft, spaced apart engagement elements securely carried by a surface of said watercraft, said engagement elements having a forward facing ledge, said seat having equally spaced apart receptacles on the underside of said seat frame shaped to only receive said engagement elements when said seat is rotated upwardly and forwardly about said engagement elements, and said engagement elements having vertical projections which center said seat on said watercraft.

2. A watercraft comprising a chair with seat securely carried on said watercraft;

said chair having a frame and comprising a seat frame, a back frame, said seat and back frames being joined via a hinged connection, the frames of both said seat and said back having material extending across the frame to provide a supported seating area and back support area, the underside front of said frame having two receptacles, an upper surface of said watercraft having secured thereto two spaced apart engagement elements for receiving said receptacles and engagement elements being shaped such that the receptacles can be inserted into and removed from the engagement elements only when the rear of the chair is rotated upwardly and forwardly about said engagement elements, said engagement elements and receptacles being locked together when the chair is rotated downwardly and rearwardly.

3. The watercraft of claim 2 wherein the watercraft is a kayak.

4. The watercraft of claim 2 wherein attachment means connect the rear of the seat to said watercraft to prevent said seat from pitching forward and disengaging said receptacles from said engagement elements.

5. A watercraft comprising:

a deck surface, a cockpit, a seat secured to said cockpit, a support element pivotally attached to the bottom rear of said seat and having a distal end, a spring to hold the support element in a stowed position beneath said seat, a means for pivotally deploying said support element, said cockpit having multiple vertically disposed notches on a generally upright surface adjacent the rear of said seat, to receive the distal end of said support element when deployed and support the rear of said seat at multiple heights.

6. The watercraft of claim 5 wherein the watercraft is a kayak.

7. The watercraft of claim 5 wherein said support element comprises spaced apart members each having distal ends and said cockpit has spaced apart vertically displaced notches to support the rear of said seat.

8. A watercraft comprising:

a seat securely carried on said watercraft, said seat having a frame, four tapered holes in proximity to the underside of the corners of said frame, four legs each having upper and lower ends, the upper ends being adapted to be removably receivable and held in said tapered holes, tension cords passing through each leg, one of end of said cord being attached at the underside of said frame, the other end being attached at the lower side of said leg, holding means associated with each leg to hold said leg in stowed position beneath said frame, said tension cords pulling the upper end of said legs toward said tapered holes when said holding means are released, allowing said upper end of said legs to be secured in said tapered holes and allowing manual withdrawal of said legs from said holes by applying tensioning force to said tension cords and allowing said legs to be returned to the stowed position.

9. The watercraft of claim 8 wherein the watercraft is a kayak.

10. A watercraft comprising:

a cockpit a seat securely received in said cockpit, said seat comprising a seat frame and a seat back frame, the seat back frame being connected by a pivot to said seat frame, spaced apart vertical racks secured to vertical surfaces of said cockpit beside said seat, an elongated member carried by said seat frame extending transversely with respect to the longitudinal dimension of said watercraft between said racks and having pinion gears fixed to said elongated member, said racks receiving said pinion gears, means for attaching the front of said seat to said elongated member, and means for locking said pinion gears in any vertical position on said racks, whereby the front of said seat can be raised and lowered about said pivot by changing the position of the pinion gears on said racks.

11. A watercraft comprising:

a cockpit, a seat securely received in said cockpit, said seat comprising a seat frame and a and a seat back frame, the seat back frame being connected by a pivot to said seat frame, spaced apart vertical racks secured to a vertical surface of said cockpit beside said seat, an elongated member extending transversely with respect to the longitudinal dimension of said watercraft between said racks and having pinion gears fixed to said elongated member, said racks receiving said pinion gears, means for attaching the front of said seat to said elongated member, means for locking said pinion gears in any vertical position on said racks, whereby the front of said seat can be raised and lowered about said pivot by changing the position of the pinion gears on said racks, wherein said means for locking comprises a spring within said elongated member connected to a pin, a vertical plate aligned with each said rack and having a series of vertically disposed holes therein for receiving the end of said pin, said spring biasing said pin through said pinion gears and vertically disposed holes, and means for overcoming said spring biasing including a manually operated element whereby when said manually operated element is operated, said pin is withdrawn from said vertical plates and said pinion gears are free to travel up and down the racks to change the height of the front of the seat and when said manually operated element is released, the pin engages one of said holes and locks the seat in place.

12. A watercraft comprising:

a cockpit a seat securely received in said cockpit, said seat comprising a seat frame and a seat back frame, the seat back frame being connected by a pivot to said seat frame, spaced apart vertical racks secured to vertical surfaces of said cockpit beside said seat, an elongated member carried by said seat frame extending transversely with respect to the longitudinal dimension of said watercraft between said racks and having pinion gears fixed to said elongated member, said racks receiving said pinion gears, means for attaching the front of said seat to said elongated member, means for locking said pinion gears in any vertical position on said racks, whereby the front of said seat can be raised and lowered about said pivot by changing the position of the pinion gears on said racks, wherein spaced apart engagement elements are fixed to said elongated member, said engagement elements each having a forward facing ledge, said seat having equally spaced apart receptacles on the underside of said seat shaped only to receive said engagement elements when said seat is rotated upwardly and forwardly about said engagement elements, and said engagement elements having vertical upwardly extending vertical projections which center said seat on said watercraft.

13. The watercraft of claim 10, 11 or 12 wherein said watercraft is a kayak.

14. A watercraft comprising:

a cockpit, a seat securely received in said cockpit, said seat comprising a seat frame and seat back frame, the seat back frame being pivotally connected to said seat frame, said seat back frame supported by a cord member on either side of said seat back frame, said cord member connecting said seat back frame to said seat frame, a transverse member connecting the sides of said seat back frame carrying means for tensioning said cord member to pull said seat back frame forward, and locking means to lock said means for tensioning, said seat back frame having a manually operated means coupled to release said locking means.

15. The watercraft of claim 14 wherein said means for tensioning comprises a linear gear and catch adapted to be locked and unlocked.

16. The watercraft of claim 14 wherein said watercraft is a kayak.

17. A watercraft comprising:

a cockpit, a seat securely received in said cockpit, said seat comprising a pivotally connected seat frame and seat back frame, said seat back frame having fabric supported by the sides of said seat back frame to provide back support, a nonrigid rod attached to said fabric on each side, said seat back frame comprising rigid channels in each of its sides, said seat back frame further comprising a transverse member extending between said channels said seat back frame having means within said transverse member to draw said rods into said rigid channels to a desired depth to increase or decrease the tension in said fabric across the sides of said seat back frame.

18. The watercraft of claim 17 wherein the watercraft is a kayak.

* * * * *